US008567740B2

(12) United States Patent
Tarnutzer et al.

(10) Patent No.: US 8,567,740 B2
(45) Date of Patent: Oct. 29, 2013

(54) DEPLOYABLE SUPPORT UNIT FOR READING MATERIAL

(76) Inventors: Byron Richard Tarnutzer, Newport Beach, CA (US); Stephen G. Hauser, Tarzana, CA (US)

( * ) Notice: Subject to any disclaimer, the term of this patent is extended or adjusted under 35 U.S.C. 154(b) by 215 days.

(21) Appl. No.: 12/847,683

(22) Filed: Jul. 30, 2010

(65) Prior Publication Data

US 2010/0294909 A1 Nov. 25, 2010

Related U.S. Application Data

(63) Continuation-in-part of application No. 11/687,768, filed on Mar. 19, 2007, now Pat. No. 7,828,260.

(60) Provisional application No. 60/767,382, filed on Mar. 23, 2006.

(51) Int. Cl.
*A47G 1/24* (2006.01)

(52) U.S. Cl.
USPC ..... 248/456; 248/455; 248/454; 361/679.55

(58) Field of Classification Search
USPC ..... 248/454, 455, 456; 312/223.2; 206/45.2; 361/679.55
See application file for complete search history.

(56) References Cited

U.S. PATENT DOCUMENTS

| | | | | | |
|---|---|---|---|---|---|
| 103,682 | A | | 5/1870 | Sullivan | |
| 213,166 | A | * | 3/1879 | Brownell | 312/231 |
| 578,325 | A | | 3/1897 | Fleming | |
| 733,100 | A | | 7/1903 | Werner | |
| 987,113 | A | | 3/1911 | Cooley | |
| 1,180,057 | A | | 4/1916 | McNamara | |
| 1,203,659 | A | | 11/1916 | Smith | |
| 2,374,409 | A | | 4/1945 | Gallagher | |
| 2,449,492 | A | * | 9/1948 | Long | 248/454 |
| D164,483 | S | * | 9/1951 | Flannery | D19/91 |
| 3,141,260 | A | | 7/1964 | Dompieri | |
| 3,381,928 | A | | 5/1968 | White | |
| 4,044,980 | A | * | 8/1977 | Cummins | 248/456 |
| 4,058,327 | A | | 11/1977 | Sullivan et al. | |
| 4,240,761 | A | * | 12/1980 | Jacobson | 402/76 |
| 4,314,635 | A | * | 2/1982 | Fraser et al. | 206/232 |
| 4,518,140 | A | | 5/1985 | Ferranto | |
| 4,544,123 | A | * | 10/1985 | Peacock | 248/460 |
| 4,555,128 | A | | 11/1985 | White | |
| 4,648,574 | A | | 3/1987 | Granlund | |
| 4,691,886 | A | | 9/1987 | Wendling et al. | |
| 4,726,556 | A | | 2/1988 | Weir | |
| 4,765,462 | A | * | 8/1988 | Rose, Jr. | 206/760 |

(Continued)

*Primary Examiner* — Terrell McKinnon
*Assistant Examiner* — Daniel J Breslin
(74) *Attorney, Agent, or Firm* — Lowry Blixseth LLP; Scott M. Lowry

(57) ABSTRACT

A support unit for supporting readable material at a convenient angle and height for facilitated viewing. The support unit is deployable between a collapsed and generally flat non-deployed position, and a deployed position with a support platen at an adjustably selected angle and height for comfortable viewing. In one embodiment, the support platen is pivotally mounted onto an intermediate bracket plate which in turn is pivotally mounted onto a base plate, with an upper support strut adjustably set to accommodate support platen positioning relative to the base plate and bracket plate in one of multiple angular settings. The support platen may include or support a digital device such as an electronic touch pad, computer or reading device. In a preferred form, the upper support strut is adapted to overlie and protect the support platen and device thereon in the non-deployed position.

13 Claims, 15 Drawing Sheets

(56) References Cited

U.S. PATENT DOCUMENTS

| | | | | |
|---|---|---|---|---|
| 4,848,243 | A * | 7/1989 | Giordano | 108/9 |
| 5,035,393 | A | 7/1991 | Menaged | |
| 5,103,376 | A | 4/1992 | Blonder | |
| D333,390 | S * | 2/1993 | McCauley | D6/429 |
| 5,290,002 | A * | 3/1994 | Cohen | 248/456 |
| 5,377,794 | A * | 1/1995 | Book | 190/1 |
| 5,607,135 | A | 3/1997 | Yamada | |
| 5,633,782 | A | 5/1997 | Goodman et al. | |
| 5,651,525 | A | 7/1997 | Yang | |
| 5,653,333 | A * | 8/1997 | Webster | 206/45.2 |
| 5,720,465 | A | 2/1998 | Peltzer et al. | |
| 5,765,799 | A | 6/1998 | Weber | |
| 5,810,316 | A | 9/1998 | Eby | |
| 6,019,050 | A * | 2/2000 | Ranta | 108/6 |
| 6,036,288 | A | 3/2000 | Shih | |
| 6,045,108 | A * | 4/2000 | Cziraky | 248/454 |
| 6,256,193 | B1 | 7/2001 | Janik et al. | |
| 6,334,687 | B1 | 1/2002 | Chino et al. | |
| 6,353,529 | B1 | 3/2002 | Cies | |
| 6,430,038 | B1 * | 8/2002 | Helot et al. | 361/679.05 |
| 6,464,185 | B1 | 10/2002 | Minelli et al. | |
| 6,540,192 | B2 * | 4/2003 | Ouellet | 248/461 |
| 6,637,139 | B1 * | 10/2003 | Chan | 40/725 |
| 6,648,293 | B1 | 11/2003 | Sachnoff | |
| 6,654,234 | B2 | 11/2003 | Landry et al. | |
| 6,700,775 | B1 | 3/2004 | Chuang et al. | |
| D494,977 | S * | 8/2004 | Persson | D14/447 |
| 6,816,365 | B2 | 11/2004 | Hill et al. | |
| 6,825,415 | B1 | 11/2004 | Chen et al. | |
| 6,848,684 | B2 | 2/2005 | Fortin et al. | |
| 6,912,121 | B2 | 6/2005 | Karidis et al. | |
| 6,913,238 | B2 | 7/2005 | Bakker et al. | |
| D513,008 | S * | 12/2005 | Takizawa et al. | D14/447 |
| 7,086,632 | B2 * | 8/2006 | Hsieh | 248/188.1 |
| 7,298,610 | B2 | 11/2007 | Kim et al. | |
| 7,327,560 | B1 | 2/2008 | Tabasso et al. | |
| 7,352,565 | B2 | 4/2008 | Yin | |
| 7,567,432 | B1 | 7/2009 | Tabasso et al. | |
| 7,735,644 | B2 * | 6/2010 | Sirichai et al. | 206/320 |
| D624,922 | S * | 10/2010 | Hui et al. | D14/447 |
| 7,828,260 | B2 * | 11/2010 | Hauser et al. | 248/456 |
| 7,911,784 | B2 * | 3/2011 | Jones | 361/679.55 |
| 2002/0141146 | A1 | 10/2002 | Mustoe | |
| 2003/0057343 | A1 | 3/2003 | Jacobs | |
| 2004/0140282 | A1 | 7/2004 | Wang | |
| 2004/0160736 | A1 | 8/2004 | Lin | |
| 2005/0105264 | A1 | 5/2005 | Chen | |
| 2006/0091222 | A1 * | 5/2006 | Leung et al. | 235/486 |
| 2006/0192070 | A1 * | 8/2006 | Chan | 248/371 |
| 2008/0149801 | A1 | 6/2008 | Wood | |
| 2009/0178938 | A1 * | 7/2009 | Palmer | 206/45.23 |
| 2009/0179132 | A1 | 7/2009 | Qin et al. | |

* cited by examiner

DEPLOYABLE SUPPORT UNIT FOR READING MATERIAL

BACKGROUND OF THE INVENTION

This invention relates generally to an improved support unit or support stand for use in supporting reading material and the like at an angular orientation and height selected for convenient and comfortable viewing. The invention is designed for supporting a broad range of different types of reading material such as a book, magazine, or other sheet-like reading materials and/or work items in a variety of different use environments including but not limited to reading, and/or supporting of work materials adjacent to a desktop or laptop computer or other electronic device or system.

Support stands and the like for use in supporting written material are generally known in the art. Such support stands typically include a support plate or platen oriented in a generally upright and rearwardly tilted position, in combination with a raised lip or stop at a lower margin thereof for supporting reading material and the like, such as a book or magazine, or other sheet-like reading or work materials. The support stand is designed for retaining the reading material in a convenient position and orientation suited for comfortable viewing. By contrast, the support stand is designed to minimize or eliminate the need for manual holding of the reading material, thereby significantly reducing fatigue to the user's hand, arm and neck muscles.

The present invention relates to an improved support unit or stand for receiving and supporting reading material and the like at a selected and adjustably variable angular orientation and height, thereby supporting the reading material at a substantially optimized reading and viewing angle.

SUMMARY OF THE INVENTION

In accordance with the invention, an improved support unit or support stand is provided for supporting reading material such as a book, magazine, or other selected papers and/or sheet-like work items at an adjustably selected and convenient angle for facilitated viewing. In addition, in accordance with at least one embodiment of the invention, the improved support unit or support stand is further adapted for adjustably and selectively varying the height of the reading material or the like relative to an underlying support surface, such as a desk or table top, or a portion of the viewer's body such as the lap. The support unit is deployable between a collapsed, generally flat and substantially two-dimensional non-deployed or stored position, and a deployed position with a support platen at an adjustably selected angle and height for comfortable viewing.

In one preferred form of the invention, the support platen is pivotally mounted onto a base plate for swinging movement between the non-deployed and deployed positions. In an alternative preferred form, the support platen is pivotally mounted onto an intermediate bracket plate which is in turn pivotally mounted onto the base plate, wherein the bracket plate permits and accommodates raising and lowering of the support platen relative to the base plate for variably adjusting the support platen height. In the non-deployed position, one or more storage compartments defined at least partially by the base plate may contain selected elements such as writing implements, and/or a reading light adapted for removable mounting onto the support platen in the deployed position.

In one alternative preferred form, an upper support strut orients the support platen at the selected position relative to the intermediate bracket plate and/or the base plate in a deployed position, but is adapted to overlie and protect the support platen in the form of a protective lid when in the non-deployed position.

The support unit incorporates, in one preferred form, components of a laptop computer including a keyboard and processor unit carried by the base plate and a computer screen carried by the support platen. The keyboard and processor unit may be slidably mounted on the base plate for displacement between a normal stored position retracted and substantially concealed therein, and an operating position protruding forwardly from the base plate for facilitated user access. The computer screen is integrated into the adjustably support platen for ease and comfort of viewing. A protective cover flap may be hingedly mounted onto the support platen for normally overlying and protecting the computer screen, and for removably supporting selected reading material and the like, when the laptop computer is not in use.

Other features and advantages of the present invention will become apparent from the following more detailed description, taken in connection with the accompanying drawing which illustrate, by way of example, the principals of the present invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
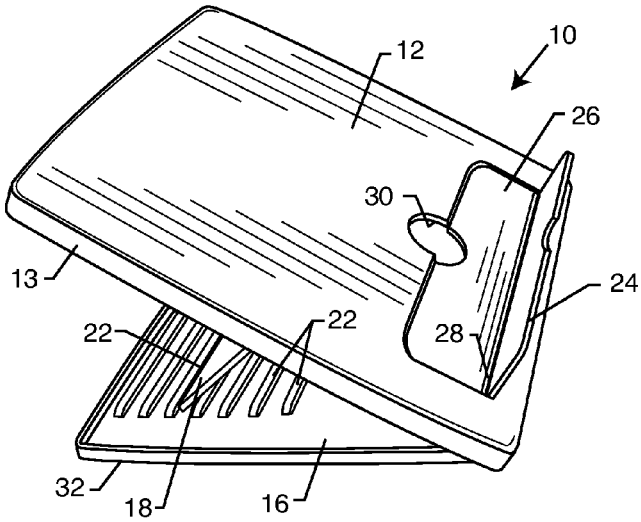
FIG. 1 is a front side perspective view showing a reading material support unit or support stand constructed in accordance with one preferred form of the present invention, and wherein the support unit is depicted with a support platen in a deployed position.
Figure 2:
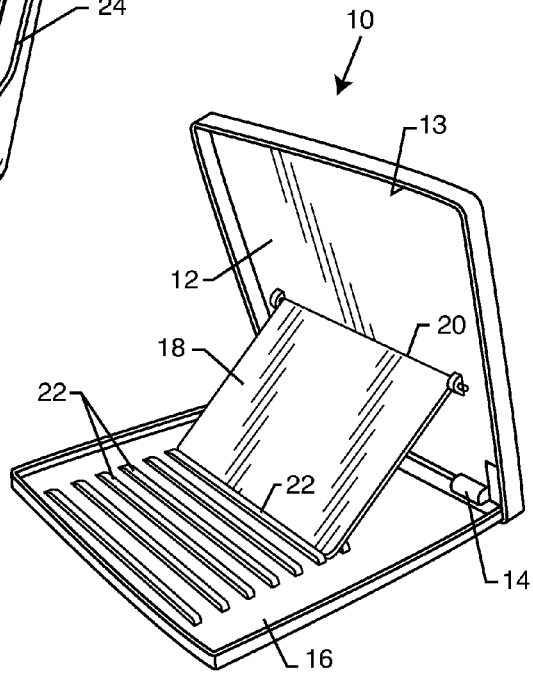
FIG. 2 is a rear side perspective view of the support unit of FIG. 1, and depicting the support unit with the support platen in an alternative deployed position.
Figure 3:
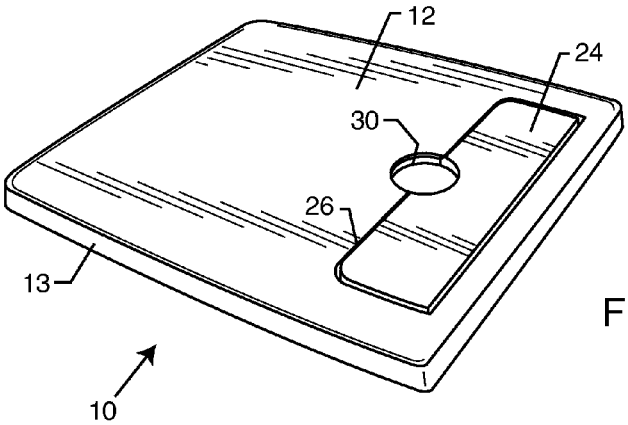
FIG. 3 is a top perspective view of the support unit of FIGS. 1-2, but wherein the support unit is shown in a collapsed or non-deployed position.

As shown in the exemplary drawings, an improved support unit or support stand referred to generally in FIGS. 1-3 by the reference numeral 10 is provided for use in supporting reading material for convenient and comfortable viewing. The support unit 10 is deployable between a collapsed, substantially flat or two dimensional configuration as viewed in FIG. 3, and any one of a plurality of different deployed positions (FIGS. 1 and 2) with a support platen 12 oriented at a selected and at least partially upright position for receiving and supporting the reading material.

The support unit 10 generally comprises the support platen 12 having a generally rectangular configuration as depicted in the illustrative drawings. This support platen 12 is hingedly or pivotally connected by means of a suitable hinge 14 (FIG. 2) mounted on the rear or underside surface of the support platen 12 near a front margin thereof to an underlying base plate 16 having a size and shape conforming generally with the platen 12. Accordingly, the support platen 12 is movable between a non-deployed position (FIG. 3) in substantially parallel and closely overlying relation with the support base 16, and a deployed position (FIGS. 1-2) tilted upwardly at a selected rearward angular orientation relative to the base plate 16. The support platen 12 may include a rearwardly or downwardly projecting peripheral rim 13 (FIG. 2) for circumscribing and concealing the base plate 16, when the two components are in the non-deployed or stored position as viewed in FIG. 3.

The support platen 12 is movable to and retained in the selected deployed or upwardly tilted angular orientation by means of a rear or first support strut 18 adapted for adjustably selected interengagement between the support platen 12 and the support base 16. The accompanying drawings show the support strut 18 hingedly or pivotally connected to the rear or underside surface of the support platen 12 by means of a suitable hinge 20, with a lower or rearward margin of said strut 18 selectively engageable with one of an array or a plurality of transversely elongated raised ribs 22 formed on an upper surface of the base plate 16. As shown in FIGS. 1-2, these ribs 22 are formed in a generally parallel spaced-apart pattern on the base plate 16, and thus provide multiple stops for respective engagement by the strut 18 for supporting the platen 12 in any selected one of a plurality of several different angular orientations relative to the base plate 16. In this regard, FIG. 1 shows the strut 18 engaged with a rib 22 disposed near a rear margin of the base plate 16, whereby the support platen 12 is retained at a modest tilt-up angle (about 30 as shown) relative to the base plate 16. By contrast, FIG. 2 shows the strut 18 engaged with a rib 22 disposed nearer to a front margin of the base plate 16, whereby the support platen 12 is retained at a relatively steeper tilt-up angle (about 80 as shown).

Persons skilled in the art will understand that the support platen 12 can thus be oriented at a selected tilt-up angle chosen from within a relatively broad range, and specifically selected by the user for supporting reading material and the like at a substantially optimized viewing and reading angle. Moreover, persons skilled in the art will appreciate that the strut 18 may be pivotally coupled to the base plate 16, and that the ribs 22 may be formed on the rear or underside surface of the support platen 12. Other alternative support strut configurations may also be used.

A support strip 24 is mounted on a front or upper surface of the support platen 12, near the front or lower margin thereof, to define an outwardly protruding lip or stop for supporting the selected reading material. In the preferred form as shown, this support strip 24 comprises a relatively narrow-width element normally nested within a matingly shaped shallow pocket 26 formed in the front or upper surface of the support platen 12. This strip 24 is hingedly or pivotally coupled to the platen 12 as by means of a suitable hinge 28 (FIG. 1) for quick and easy movement between a stored or non-deployed position lying substantially flat within the pocket 26 (FIG. 3) and a deployed position (FIG. 1) extending generally perpendicularly to the plane of the support platen 12. A finger hole 30 may be formed in the support platen 12 bridging partially into the pocket 26 at a side edge thereof opposite to the strip hinge 28 for facilitated manual grasping of the adjacent edge of the strip 24 and fingertip displacement thereof from the non-deployed to the deployed position.

In the substantially two-dimensional or flat non-deployed orientation shown in FIG. 3, the support platen 12 and the underlying base plate 16 are arranged in closely overlying and substantially parallel relation, with the support strut 18 nested in substantially parallel relation therebetween. In addition, the support strip 24 is nested within the platen pocket 26, in substantially co-planar relation to the support platen 12. These components, namely, the support plate 12, base plate 16, strut 18 and support strip 24 are conveniently constructed from lightweight and relatively cost-efficient materials, such as molded plastic, to provide a convenient, lightweight and easily portable unit.

However, the support platen 12 is quickly and easily moved to a selected tilt-up deployed position and retained in that selected position by the hinged support strut 18 engaged with a selected one of raised ribs 22 on the base plate 16. In addition, the front support strip 24 is quickly and easily shifted from the stored or nested position to a deployed position projecting outwardly from and generally perpendicularly to the plane of the support platen 12. In this selected deployed position, reading material or the like can be supported by the platen 12 and associated stop strip 24 at the selected, substantially optimized viewing and reading angle. The unit 10 can be placed upon a selected support surface, such as a desktop or tabletop or the like. In addition, the unit 10 can be rested upon other types of underlying support surfaces, such as upon the lap or legs of a user in a sitting or reclined position. In this regard, a selected non-skid material 32, such as a soft pad or a rubberized or foam layer or the like, can be mounted on the underside of the base plate 16 for improved stable positioning of the unit 10 onto any selected support surface.

FIGS. 4-12 depict a modified support unit or support stand 110 constructed in accordance with one alternative preferred form of the present invention, wherein components corresponding in structure and/or function with those shown and described in FIGS. 1-3 are identified by common reference numerals increased by 100. As shown, the modified support unit 110 includes a deployable support platen 112 and an associated support plate 116, but wherein these components are hingedly interconnected by an intermediate bracket plate 40 (shown best in FIGS. 8-10). With this construction, the support platen 112 can be oriented at a selected tilt-up deployed position, and also at a selected vertical height position relative to the underlying support base 116.

More particularly, the support platen 112 is pivotally or hingedly coupled by means of suitable hinges 114 (FIGS. 6 and 7) mounted on the rear or underside surface of the support platen 112 near a front margin thereof to the underlying intermediate bracket plate 40 generally at or near a front margin of said bracket plate. Accordingly, the support platen 112 is movable between a non-deployed position (FIGS. 11-12) in closely overlying and substantially parallel relation with the bracket plate 40, and a deployed position (FIGS. 4-10) tilted upwardly at a selected angular orientation relative to the bracket plate 40. This intermediate bracket plate 40 is pivotally or hingedly coupled in turn as by means of bracket hinges 42 (FIGS. 8-9) at a rear margin thereof generally at or near an associated rear margin of the underlying base plate 116.

Figure 6:
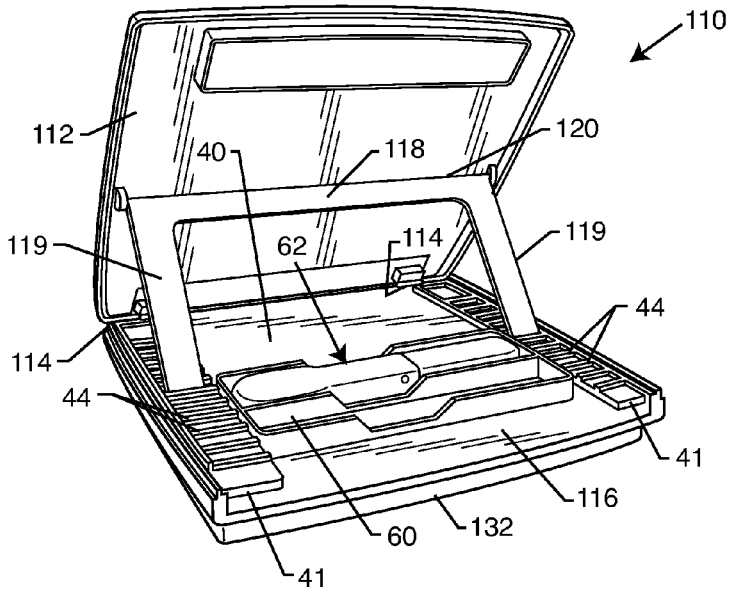
FIG. 6 is a rear perspective view of the support unit shown in FIGS. 4-5, and illustrating the support unit in said first deployed position.
Figure 7:
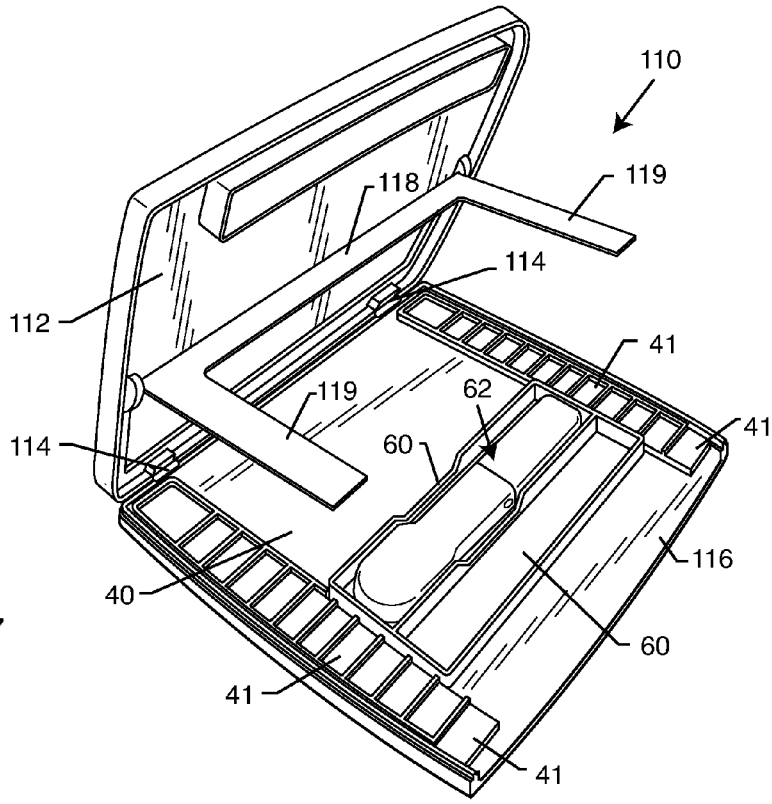
FIG. 7 is a rear perspective view similar to FIG. 6, but showing manipulation of a pivotally mounted rear strut for selectively orienting the support unit in the first deployed position.
Figure 8:
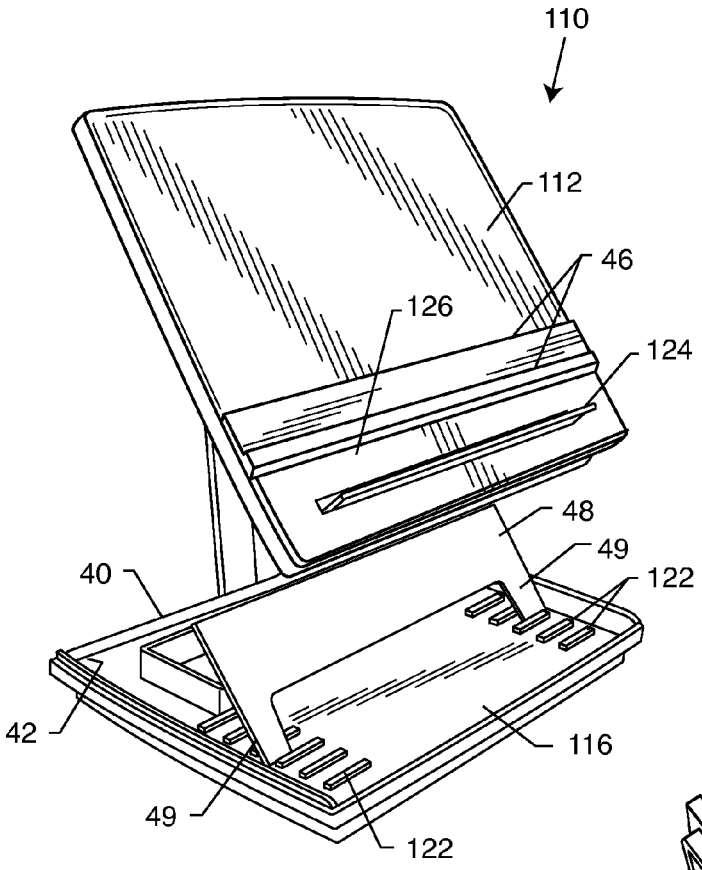
FIG. 8 is a front perspective view of the support unit of FIGS. 4-7, but showing the support unit with the support platen in a second and elevated deployed position.
Figure 9:
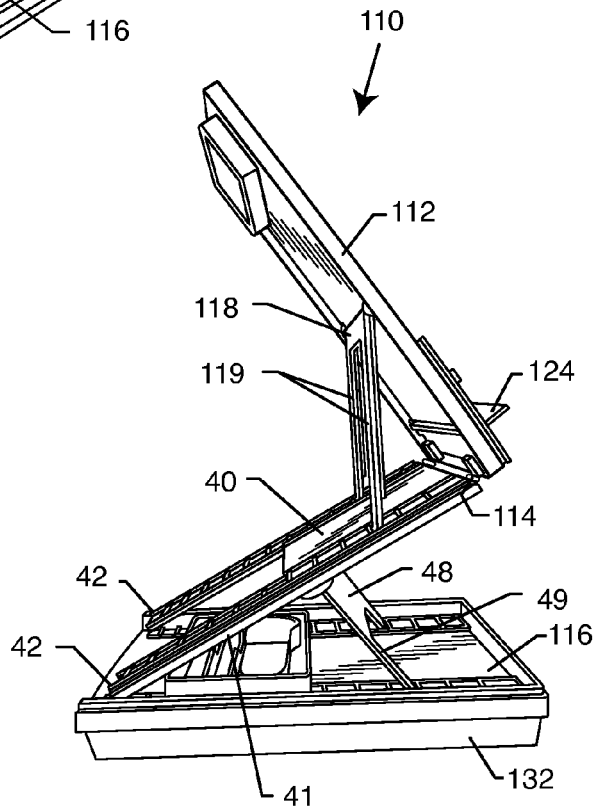
FIG. 9 is a left side elevational view of the support unit in the second deployed position as viewed in FIG. 8.
Figure 10:
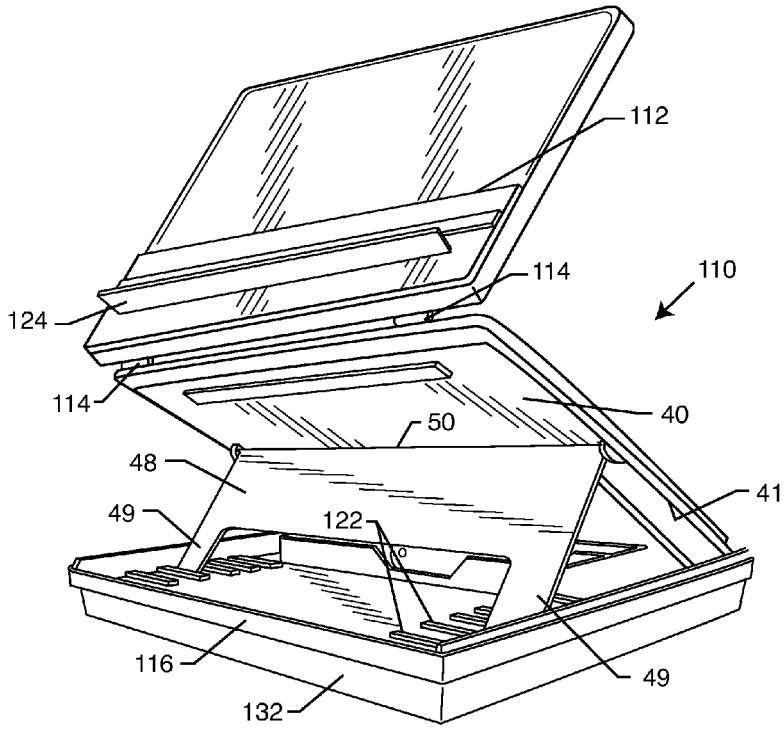
FIG. 10 is an enlarged and fragmented front elevational view of the support unit in the second deployed position.

The support platen 112 is thus movable to and retained in the selected deployed or upwardly tilted angular orientation by means of a rear or first support strut 118 adapted for adjustably selected interengagement between the support platen 112 and the intermediate bracket plate 40. The accompanying drawings show the support strut 118 hingedly or pivotally connected to the rear or underside surface of the support platen 112 by means of a suitable strut hinge 120 (FIGS. 6-7), with a lower or rearward margin of said strut 118 selectively engageable with one of an array or a plurality of transversely elongated raised ribs 44 formed on an upper surface of the bracket plate 40. As shown in FIGS. 6-7, these ribs 44 are formed in generally parallel spaced-apart relation on the bracket plate 40, and thus provide multiple stops for engagement by the strut 118 for supporting the platen 112 in a selected one of several different angular orientations relative to the bracket plate 40. In this regard, FIGS. 6-7 shows the strut 118 with a generally U-shaped configuration defining a pair of downwardly and rearwardly extending legs 119 for respectively engaging raised ribs 44 formed in a pair of transversely aligned rib sets or tracks generally at opposite sides of the intermediate bracket plate 40.

Figure 4:
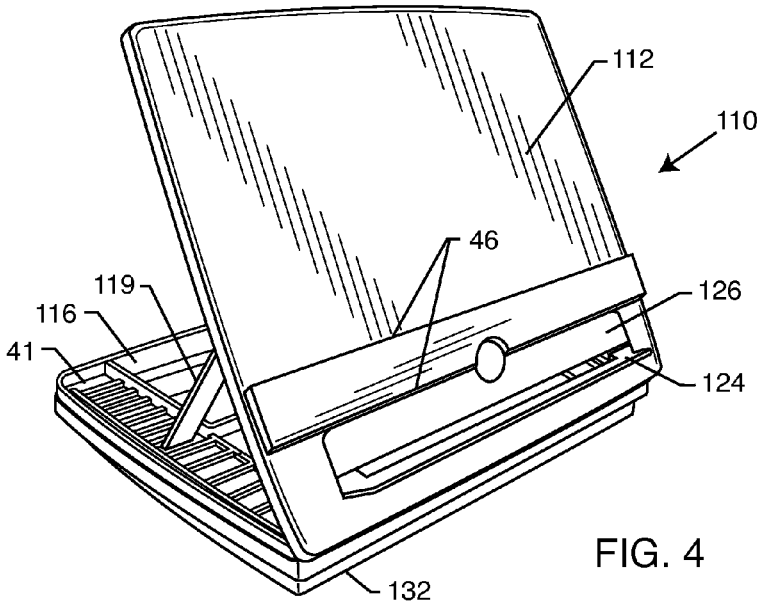
FIG. 4 is a front perspective view illustrating the front and left sides of a reading material support unit constructed in accordance with an alternative preferred form of the invention, and depicting the support unit with a support platen in a first deployed position.
Figure 5:
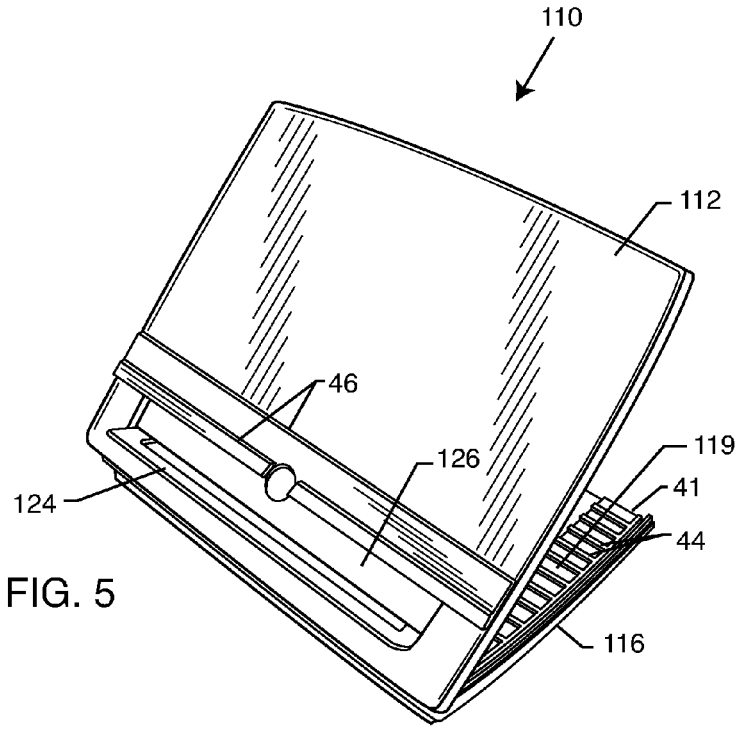
FIG. 5 is a front perspective view similar to FIG. 4 but depicting the front and right sides of the support unit in said first deployed position.

Accordingly, the support platen 112 can be adjustably set at a selected deployed, upwardly tilted orientation relative to the underlying components including the bracket plate 40 and the base plate 116, as viewed in FIGS. 4-5. The specific angular orientation of the support platen 112 relative to the underlying structures is determined by the selected raised ribs 44 on the upper side of the bracket plate 40 which are engaged by the lower or rearward ends of the legs 119 of the rear support strut 118. A front side of the support platen 112 defines one or more transversely extending stop lips 46 for supporting reading material on the support platen 112 at a selected vertical position. If desired, the support platen 112 may also include a front support strip 124 hingedly or pivotally movable between a non-deployed position (FIG. 11) nested substantially within a pocket 126 on the support platen 112, and a deployed position (FIGS. 4-5 and 8-9) projecting outwardly from the platen 112 to support reading material (in the same manner as previously shown and described herein with respect to FIGS. 1-3).

The modified support unit 110 may be further adjusted for variably selecting the height of the support platen 112 relative to the underlying base plate 116 by shifting the intermediate bracket plate 40 to an upwardly tilted orientation. That is, the bracket plate 40 can be raised about the hinges 42 relative to the underlying base plate 116, with an underlying bracket or second support strut 48 engaged between the bracket plate 40 and the base plate 116 as viewed in FIGS. 8-10. This bracket support strut 48 is shown hingedly or pivotally coupled to the underside or rear side of the bracket plate 40 as by means of a suitable hinge 50. When the bracket plate 40 is raised, the strut 48 can be oriented to engage one of a plurality of raised ribs 122 formed on the base plate 116 to retain the bracket plate 40 in the selected raised position. As shown (FIGS. 8-10), the preferred bracket strut 48 has a generally U-shaped configuration defining a pair of downwardly or rearwardly extending strut legs 49 for respectively engaging the ribs 122 formed on the base plate 116 in a transversely aligned pair of rib sets or tracks generally at opposite sides of the base plate.

Figure 11:
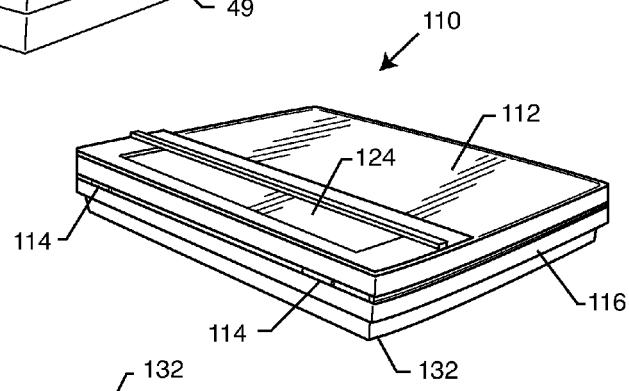
FIG. 11 is a top perspective view showing the support unit of FIGS. 4-10 in a collapsed, non-deployed position.
Figure 12:
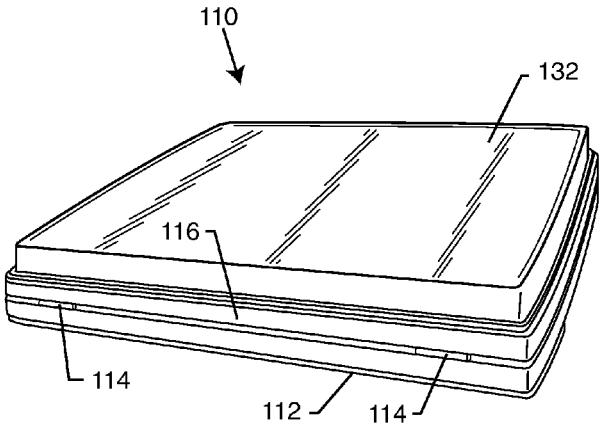
FIG. 12 is a bottom perspective view of the support unit of FIGS. 4-11 in the collapsed, non-deployed position.
Figure 13:
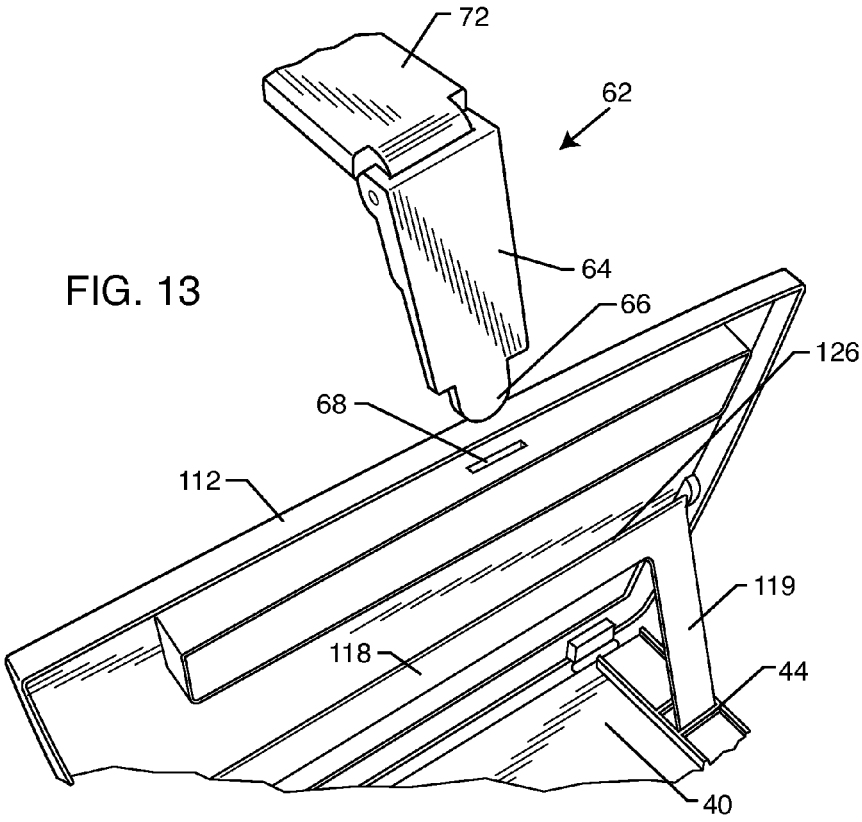
FIG. 13 is an enlarged and fragmented rear perspective view, shown partially in exploded form, and depicting installation of a reading light onto the support unit in the deployed position.

With this construction, the support plate 112, intermediate bracket plate 40, and base plate 116 can be oriented in a low profile, substantially two-dimensional non-deployed position in a closely stacked parallel array, as viewed in FIGS. 11-12. From this non-deployed position, the support platen 112 can be raised to a selected tilt-up angle representing a selected deployed position for supporting reading material. If desired, the intermediate bracket leg 40 may also be raised to a selected tilt-up angle for purposes of adjusting the vertical height position of the support platen 112 relative to the underlying base plate 116. The support unit 110 thus supports the selected reading material at an individually chosen angle and height for optimized user viewing. The base plate 116 may, of course, be supported on any convenient support surface such as a desktop or tabletop, or alternately upon a user's lap, etc. A suitable non-skid or soft pad surface 132 (FIGS. 9-10 and 12) may be provided on the underside of the base plate 116.

In the preferred form, the intermediate bracket plate 40 also has a generally U-shaped configuration defining a front segment for pivotal connection to the support platen 112 by means of the hinges 114, and a pair of rearwardly projecting bracket legs 41 for connection to the rear margin of the base plate 116 by means of the hinges 42. With this construction, the space between the bracket plate legs 41 is open and exposed to reveal a portion of the underlying base plate 116, when the support platen 112 is raised. Accordingly, this exposed portion of the base plate 116 may be formed to define one or more storage pockets 60 (FIGS. 6-7) for receiving and supporting useful articles such as writing implements (not shown) and a compact deployable light unit 62. When the support platen 112 is raised to one of the selected deployed positions, articles contained within these storage pockets 60 can be conveniently accessed and used, as desired or needed.

Figure 14:
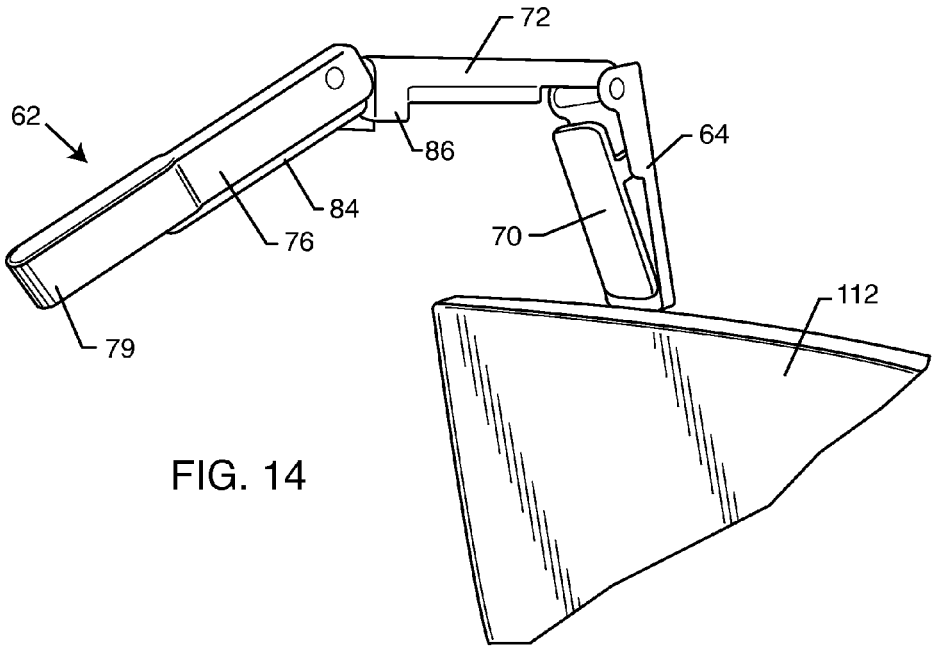
FIG. 14 is an enlarged and fragmented front perspective view showing the reading light installed onto the support unit.

FIGS. 13-17 depict the compact light unit 62 constructed in accordance with one preferred form of the invention. As shown, the light unit 62 comprises an elongated housing including a mounting or base segment 64 having a mounting tab 66 at one end thereof for quick and easy slide-fit reception into a mounting slot 68 (FIG. 13) formed generally at an upper margin of the raised support platen 112. Alternately, the light unit 62 can be removably secured to the support platen 112 at the upper margin, or at any other position, or to another adjacent structure proximate to the reading material supported on the platen 112, as by means of spring clamp 70 (FIG. 14). Alternative mounting devices such as clips and the like may also be used.

Figure 15:
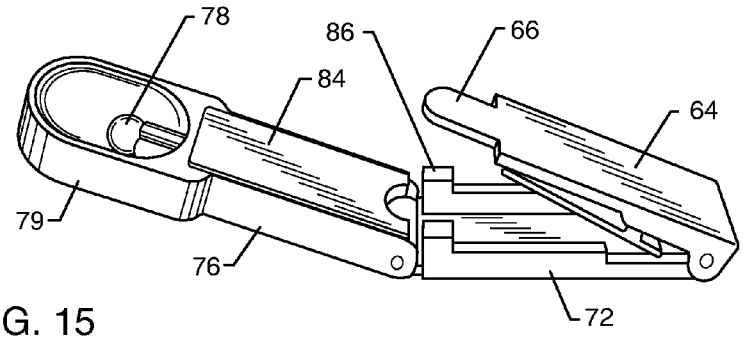
FIG. 15 is an enlarged perspective view of the reading light in accordance with one preferred form thereof.
Figure 16:
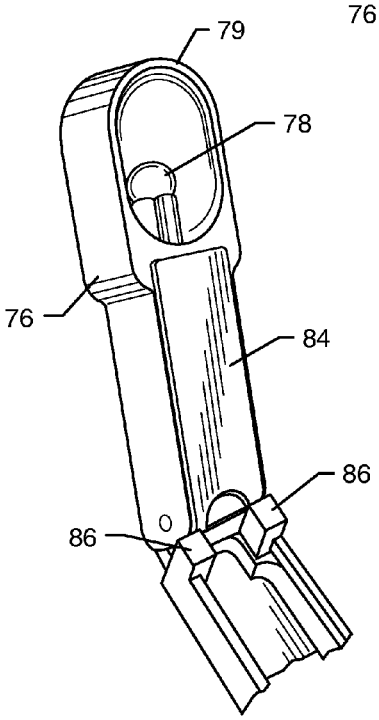
FIG. 16 is a fragmented perspective view of the reading light in an operative or illuminated orientation.
Figure 17:
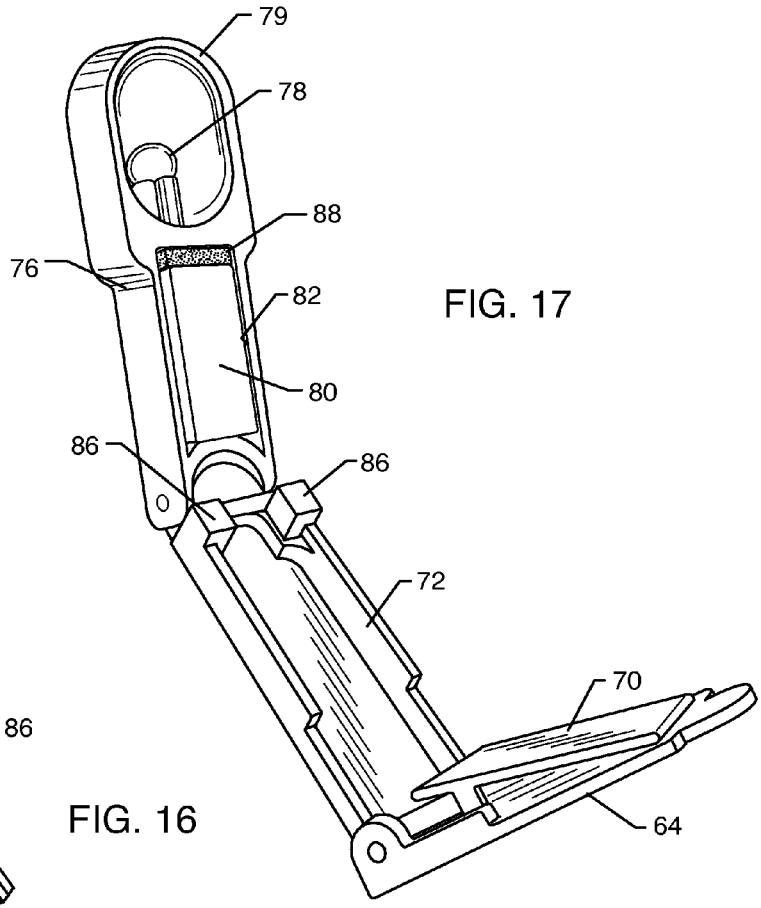
FIG. 17 is a perspective view similar to FIG. 16, but with a battery compartment cover removed to illustrate operation of the reading light
Figure 18:
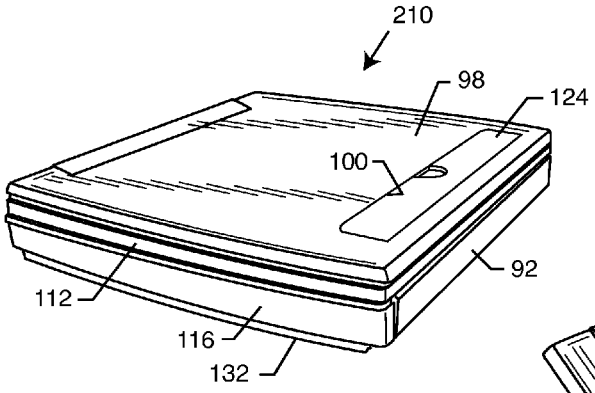
FIG. 18 is a top perspective view similar to FIG. 11, but depicting a modified embodiment incorporating a laptop computer.

The light unit 62 has an articulated construction including a central cam segment 72 mounted pivotally between the mounting segment 64 (including the mounting tab 66 and the spring clamp 70) and a light housing 76. As shown best in FIGS. 15-17, the light housing 76 includes a suitable bulb or light source 78 positioned within an open-sided shroud 79 for generally unidirectional casting of light when the bulb 78 is energized. In this regard, while a small incandescent lamp bulb 78 is depicted in FIGS. 15-17, persons skilled in the art will appreciate that alternative light sources such as LED's and the like may be used. A battery power source 80 (FIG. 17) is contained within a battery compartment 82 normally closed by a removable access cover 84 (FIG. 16). The battery 80 is positioned for slidable movement within the compartment 82, upon engagement by a pair of cams 86 on the cam segment 72, when the light housing 76 is pivotally displaced relative to the cam segment 72. Such sliding battery movement results in closure of an electrical circuit and corresponding energization of the light source 78 to illuminate the reading material on the support platen 112, when the light unit is in an unfolded or deployed orientation. Reverse pivotal movement of the light housing 76 relative to the cam segment 72 to a folded or non-deployed orientation results in spring-loaded retraction of the battery 80, and corresponding de-energization of the light source 78. A spring element 88, such as the illustrative resilient foam member, is interposed between the battery 80 and the shroud 79 to retract the battery and de-energize the light source 78.

This light unit 62 is thus mounted quickly and easily onto the deployed support platen 112, when and if desired by the user. In a normal mounted position, the cam segment 72 and the light housing 76 extend forwardly above the upper margin of the support platen 112 (FIG. 14) to position the shroud 79 in a downwardly open position for illumination of the front side of the support platen 112 and reading material positioned thereon. In this regard, the light source 78 is energized simply by pivoting the light housing 76 downwardly relative to the cam segment 72 to complete the battery power circuit, as described above. Upon completion of use of the light unit 62, the unit is quickly and easily de-mounted from the support platen 112 and returned to the associated storage pocket 60 on the base plate 116. FIG. 15 shows the mounting segment 64 pivoted into overlying relation with the central cam segment 72 for reducing the overall unit length to fit within one of the storage pockets 60.

Persons skilled in the art will appreciate that alternative light source devices may be used, including but not limited to devices including an adapter for plug-in connection to an appropriate a-c power source.

FIGS. 18-21 illustrate a further modified support unit or support stand 210 constructed in accordance with a further alternative preferred form of the present invention, wherein components corresponding in structure and/or function with those shown and described in FIGS. 4-12 are identified by common reference numerals. As shown, the modified support unit 210 includes a laptop computer 90 including a keyboard and processor unit 92 carried by the base plate 116, and a computer screen 94 carried by the support platen 112.

Figure 19:
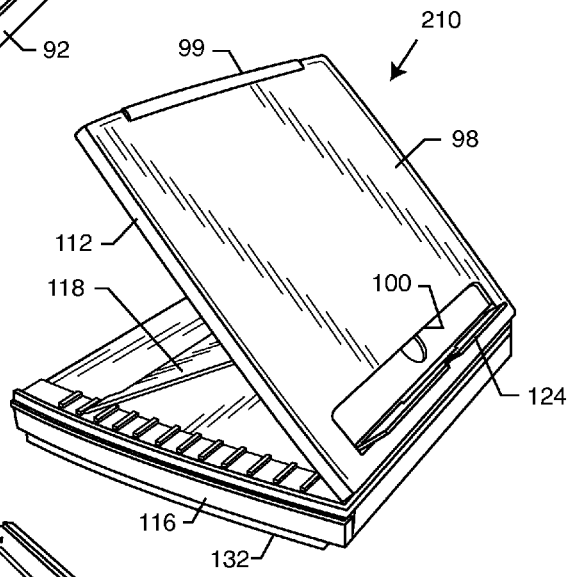
FIG. 19 is a top perspective view similar to FIG. 4, but illustrating the laptop computer embodiment of FIG. 18 in a first deployed position.
Figure 20:
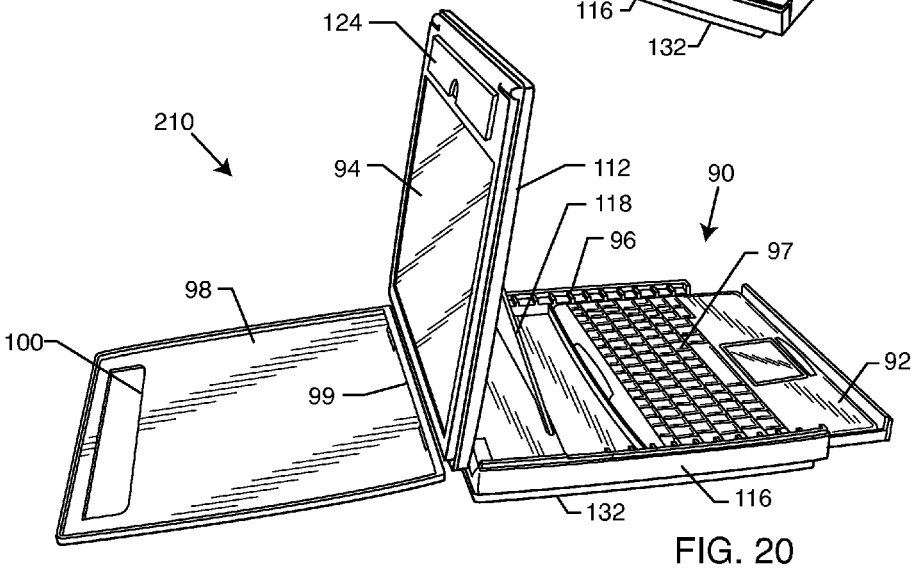
FIG. 20 is a perspective view of the laptop computer embodiment of FIG. 18 to illustrate a computer keyboard and processor unit and a computer screen.
Figure 21:
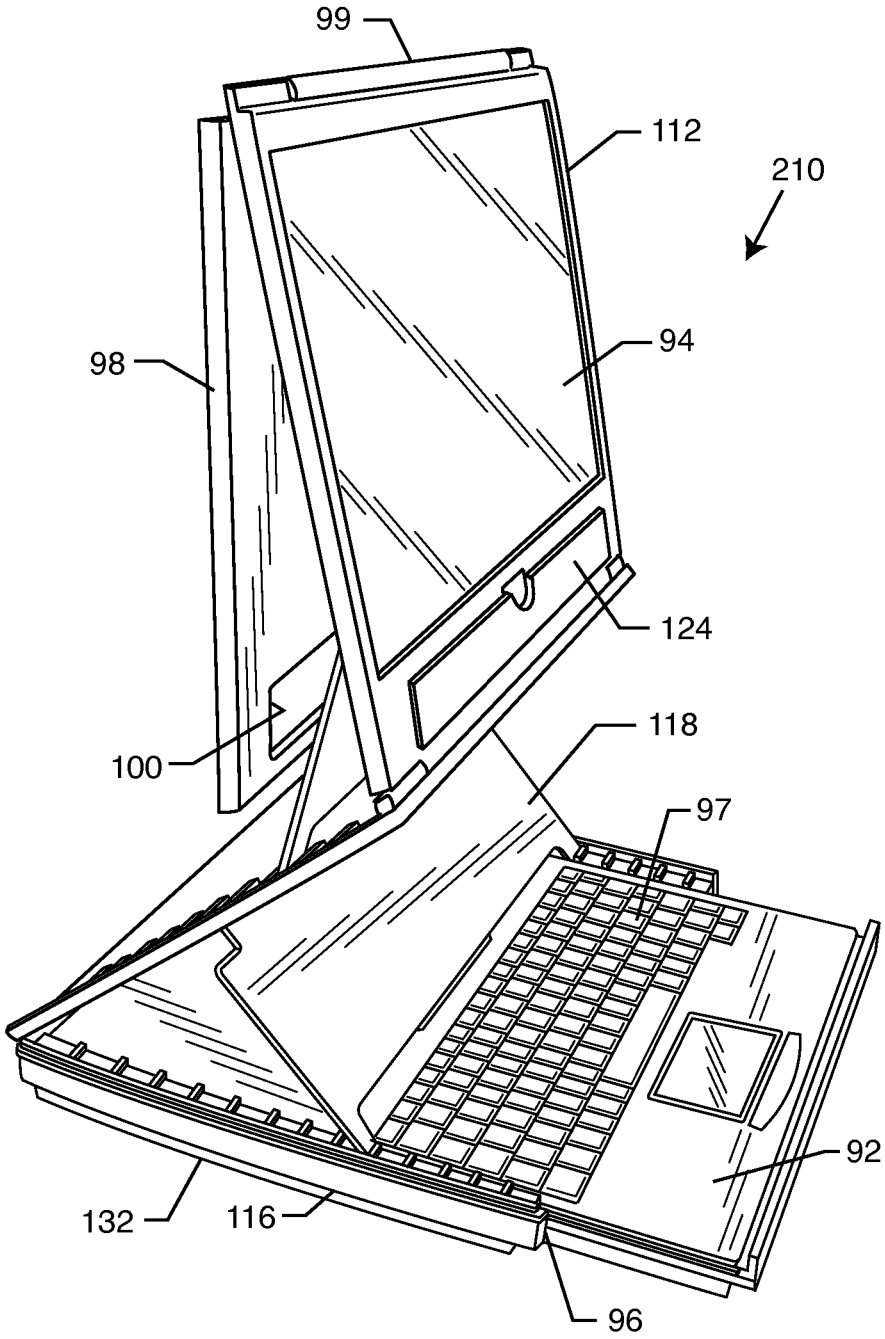
FIG. 21 is a perspective view similar to FIG. 8, and showing the laptop computer embodiment of FIG. 18 in a second and elevated deployed position.

More particularly, the keyboard/processor unit 92 is slidably supported by the base plate 116 for sliding displacement along a track 96 (FIG. 20) at laterally opposite sides thereof between a normal concealed and stored position (FIGS. 18-19) and an extended operating position protruding at least a short distance forwardly from a front margin of the base plate 116 as viewed in FIGS. 20-21. In the operating position, the keyboard array 97 on the keyboard unit 92 is sufficiently exposed for user access and key manipulation to operate the computer 90. Detents (not shown) may be provided for substantial but releasable snap-fit retention of the keyboard and processor unit 92 normally in the concealed and stored position. Persons skilled in the art will recognize and appreciate that alternative means may be provided for releasably retaining the keyboard unit 92 normally in the concealed and stored position.

The support platen 112 is adjustably positioned at a selected height and at a selected angular orientation, as previously shown and described with respect to FIGS. 4-12, to position the computer screen 94 (FIG. 21) such as an LCD or other standard flat panel display at a convenient height and angular position for ease of viewing. Alternately stated, in this embodiment, the computer screen 94 provides the reading material viewed by the user.

A protective cover flap 98 is mounted on the support platen 116 having the computer screen 94 integrated therewith, for selectively overlying and protecting the computer screen 94 when the laptop computer 90 is not in use. FIGS. 19-21 show this cover flap 98 swingably mounted onto the support platen 116 at a rearward or upper margin thereof by means of a suitable hinge 99. This cover flap 98 may, if desired, incorporate an opening 100 for exposing the pivotally mounted support strip 124 (FIGS. 18-19) on the support platen 112, whereby the support strip 124 can be deployed (FIG. 19) as previously shown and described to support reading material and the like irrespective of the position of the cover flap 98. Importantly, when the computer 90 is not in use, the cover flap 98 overlies the computer screen 94 to protect it against undesired damage as by scratching and the like. However, when use of the computer 90 is desired, the cover flap 98 is swingably shifted quickly and easily to a position draped behind the elevated support platen 116 (FIG. 21) to expose the computer screen 94 for easy and comfortable user viewing.

FIG. 20 shows the computer screen 94 pivoted relative to the base plate 116 to face directionally away from the associated keyboard unit 92. Thus, FIG. 20 shows the computer screen shifted so that a person or persons sitting across a desk from the computer user may see the display screen 94. For this orientation, suitable software is incorporated into the laptop computer 90 for quickly and easily, as by means of a simple predetermined key stroke, inverting the image or images on the display screen 94 for viewing in the orientation shown in FIG. 20. Such software would then permit quick and easy re-inversion of the display screen image or images upon return movement of the screen 94 to a normal position (FIG. 21) facing the computer user.

While the computer embodiment is shown in FIGS. 18-21 in connection with the support unit 110 as shown and described in further detail in FIGS. 4-12, persons skilled in the art will understand that the laptop computer 90 may be incorporated into the support unit 10 of FIGS. 1-3.

Figure 22:
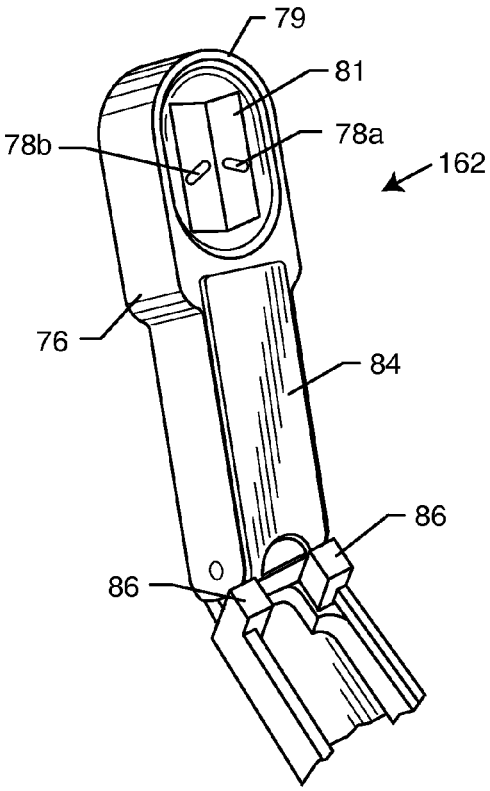
FIG. 22 is a fragmented perspective view similar to FIG. 16, but depicting a pair of LED type light sources supporting for producing diverging light beams.
Figure 23:
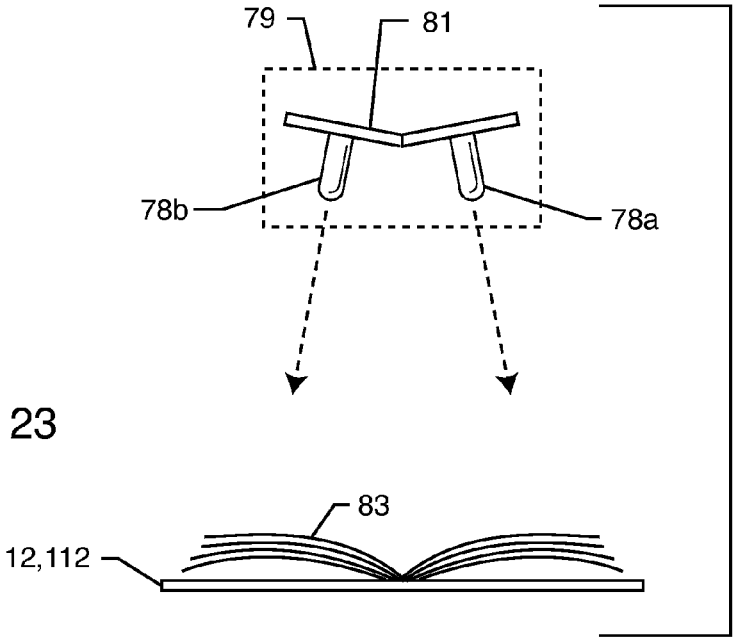
FIG. 23 is a schematic diagram showing the pair of LED light sources of FIG. 22 producing relatively wide angle illumination of reading material on an associated support platen.

FIG. 22 shows a modified light unit 162 similar to the one depicted in FIGS. 13-17, and including a pair of light sources 78*a* and 78*b* preferably in the form of a pair of LED type elements. This pair of light sources 78*a*, 78*b* are supported within the shroud 79 on a suitable substrate 81 such as a small circuit board structure of generally nonplanar shape. Importantly, the two light sources 78*a*, 78*b* are oriented on the substrate 81 to produce individual light beams, when energized, which diverge (as shown best in FIG. 23) to provide wide angle illumination of reading material such as magazine or book 83 supported on an associated support platen 12 or 112. Such wide angle illumination of the reading material is believed to improve the ease and comfort of using the support unit, with minimal eye strain or eye fatigue, during night-time or low light conditions.

FIGS. 24-30 depict a further modified support unit or support stand 310 constructed in accordance with a further alternative preferred form of the present invention, wherein components corresponding in structure and/or function with those shown and described in FIGS. 4-12 are identified by common reference numerals in the 300 series. As shown, the further modified support unit 310 includes a deployable support platen 312 and an associated support or base plate 316, wherein these components are hingedly interconnected by an intermediate bracket plate 340 (shown best in FIGS. 24-26). With this construction, the support platen 312 can be oriented at a selected tilt-up deployed position, and also at a selected vertical height position relative to the underlying support or base plate 316, and/or also with respect to the underlying intermediate support bracket 340. A electronic and preferably digital device 350 such as a computer or computer touchpad, or an electronic reading device, or the like is supported by the support platen 312 in the selected elevated or deployed orientation for facilitated reading and/or appropriate manipulation. Persons skilled in the art will recognize and appreciate that other types of reading material and/or devices may be supported by the support platen 312.

Figure 27:
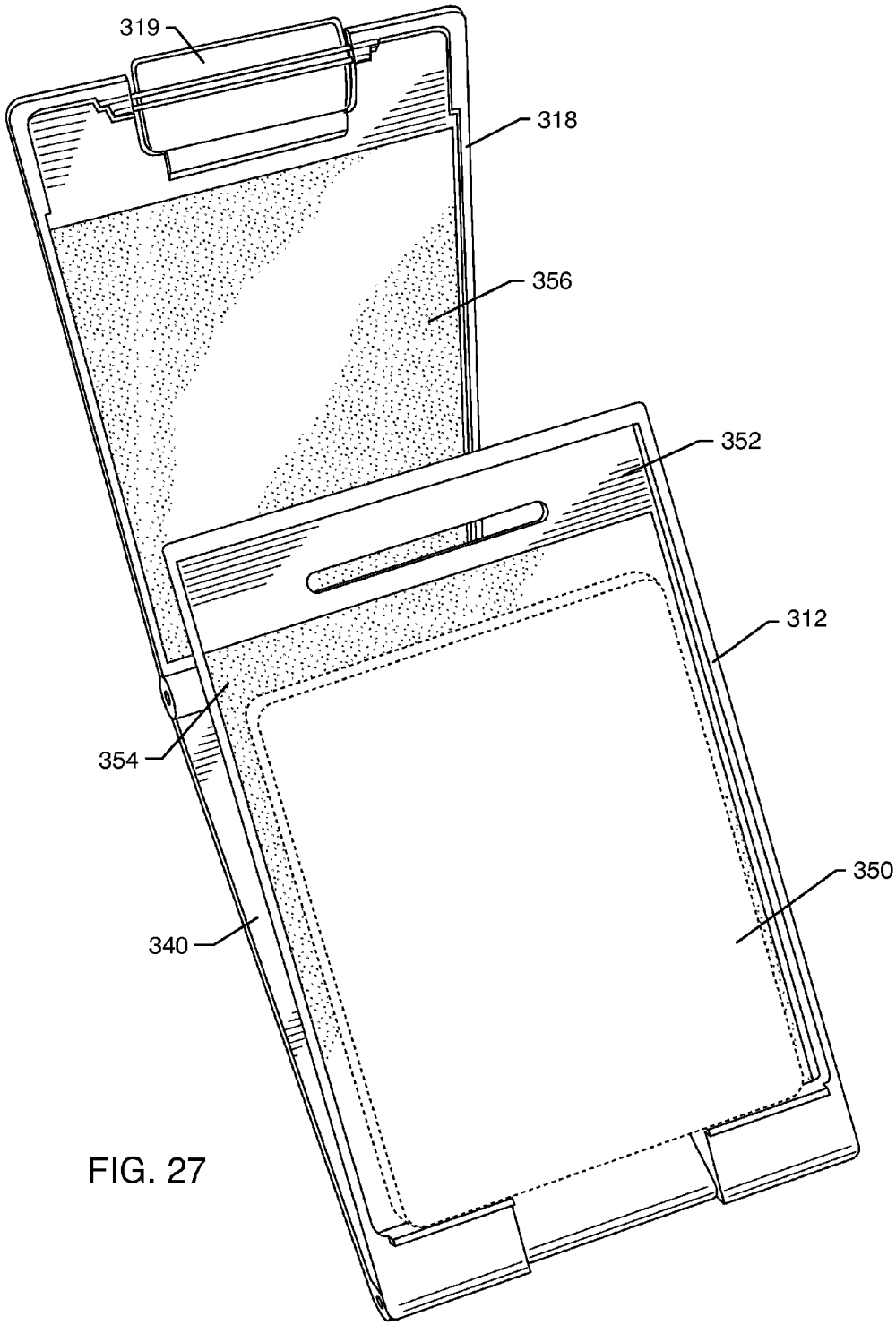
FIG. 27 is an enlarged and fragmented perspective view illustrating a support platen of the alternative embodiment of FIGS. 24-26 supporting the digital device and depicting manipulation of the support platen relative to a upper support strut.
Figure 28:
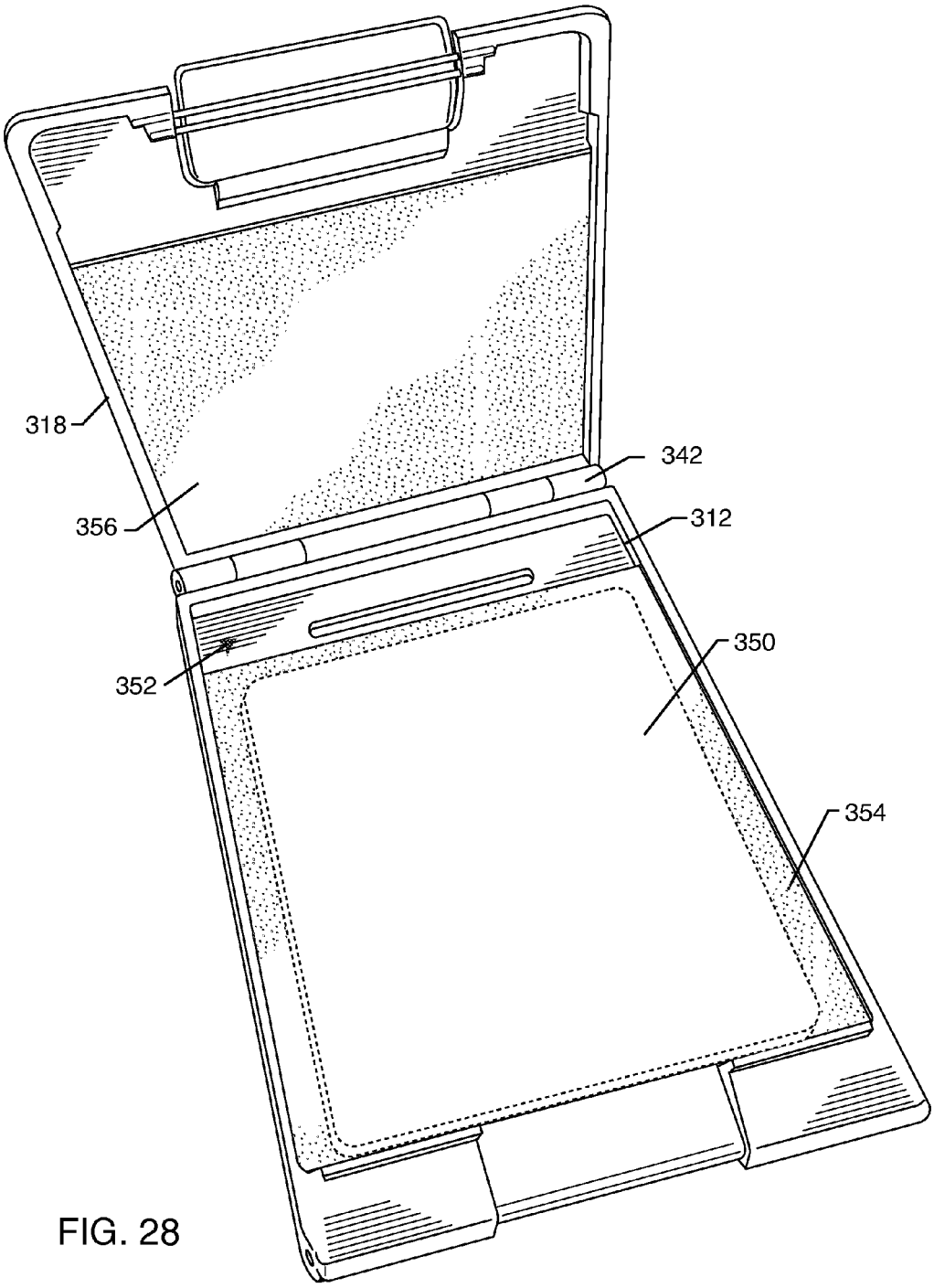
FIG. 28 is an enlarged and fragmented perspective view similar to FIG. 27, and showing nested movement of the support platen with digital device thereon to a protected non-deployed position underlying the upper support strut.
Figure 29:
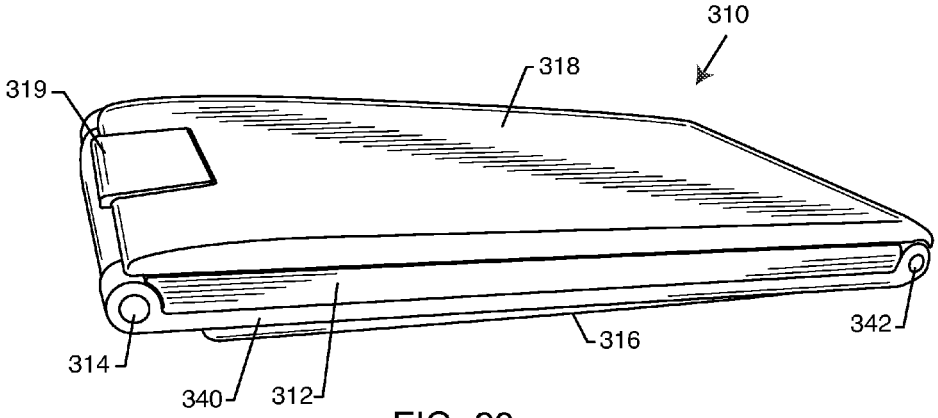
FIG. 29 is a side perspective view showing the support unit of FIG. 24-28 in a non-deployed position with the upper support strut protectively overlying the support platen with digital device thereon.

However, as shown in FIGS. 27-29, an upper support strut 318 has a generally plate-like geometry and beneficially comprises an upper closure lid for the support unit 310 and the platen 312 with the electronic device 350 supported thereon, when the unit is in the folded and collapsed, or non-deployed position (FIG. 29).

More particularly, the support platen 312 is pivotally or hingedly coupled by means of suitable hinges 314 (FIGS. 24 and 25) mounted on the rear or underside surface of the support platen 312 at or near a front margin thereof to the underlying intermediate bracket plate 340 generally at or near a front margin of said bracket plate. Accordingly, the support platen 312 is movable between a collapsed or non-deployed position (FIG. 29) in closely overlying and substantially parallel relation with the bracket plate 340, and a deployed position (FIGS. 24-25 and 30) tilted upwardly at a selected angular orientation relative to the bracket plate 340. This intermediate bracket plate 340 is pivotally or hingedly coupled in turn as by means of a bracket hinge 342 (FIGS. 24-25) at a rear margin thereof and located generally at or near an associated rear margin of the underlying base plate 316.

The support platen 312 is thus movable to and retained in the selected deployed or upwardly tilted angular orientation by means of the upper or first support strut 318 adapted for adjustably selected interengagement between the support platen 312 and the intermediate bracket plate 340. The accompanying drawings show the support strut 318 hingedly or pivotally connected to a rear margin of the intermediate bracket plate 340 by means of the hinge 342 (FIGS. 24-25), with an upper or forward margin of said strut 318 including a tab 319 selectively engageable with one of an array or a plurality of transversely elongated recessed slots 344 formed on the rearward or lower surface of the support platen 312. As shown in FIG. 25, these slots 344 are horizontally oriented and formed in generally parallel spaced-apart relation on the support platen 312, and thus provide multiple stops for engagement by the strut tab 319 for supporting the platen 312 in a selected one of several different angular orientations relative to the bracket plate 340.

Accordingly, the support platen 312 can be adjustably set at a selected deployed, upwardly tilted orientation relative to the underlying components including the intermediate bracket plate 340 and the base plate 316. The specific angular orientation of the support platen 312 relative to the underlying structures is determined by the selected slot 344 into which the strut tab 319 is received.

A front side of the support platen 312 defines a shallow recessed seat 252 lined with a foam pad 354 (FIGS. 27-28) or the like for securely receiving and supporting the electronic device 350, such as the digital reader as shown.

Figure 24:
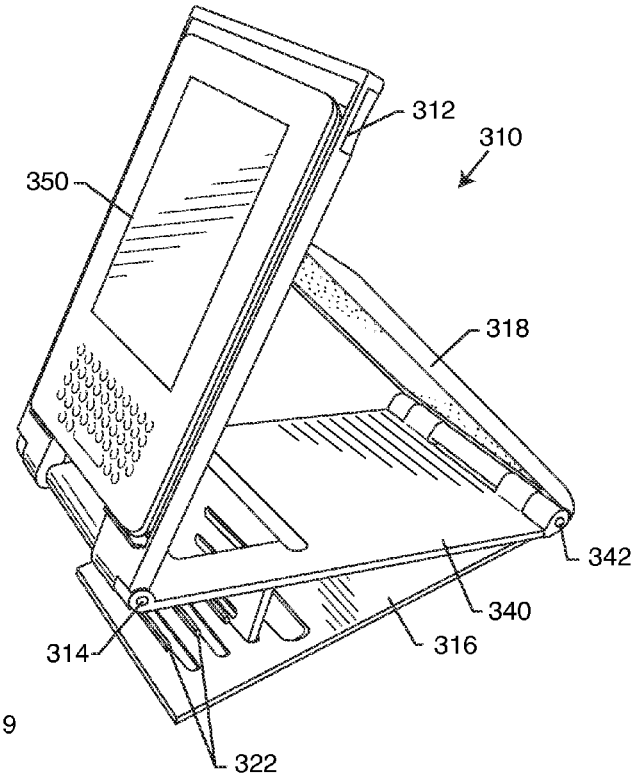
FIG. 24 is a front perspective view of a further alternative preferred form of the invention, and illustrating the support unit in a fully deployed position supporting a digital device supported thereon in a viewable position.
Figure 25:
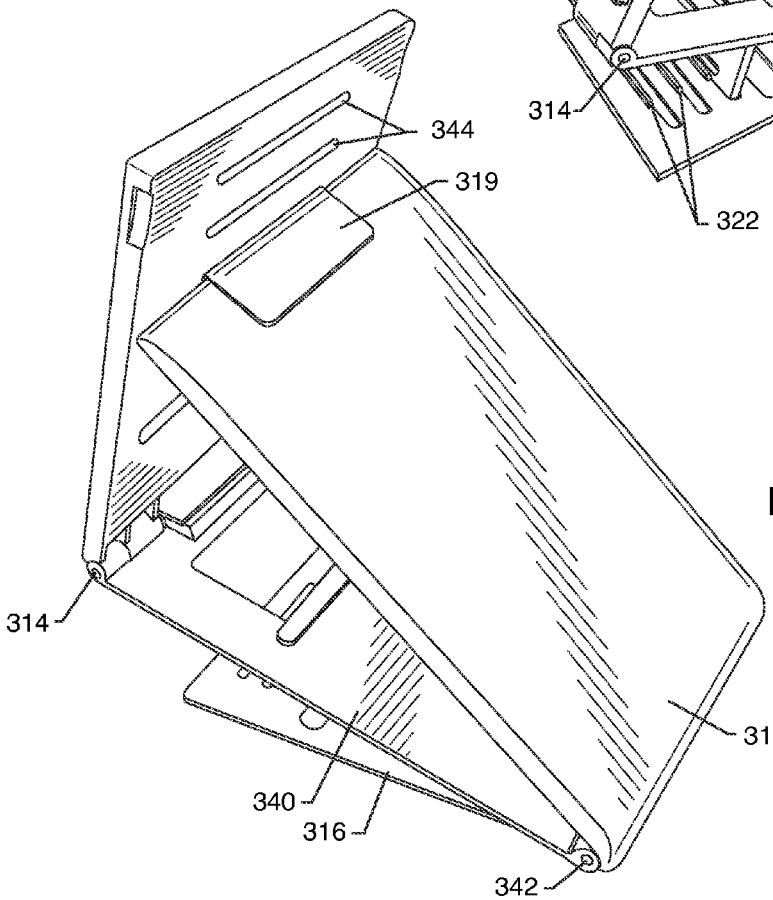
FIG. 25 is a rear perspective view of the embodiment of FIG. 24.
Figure 26:
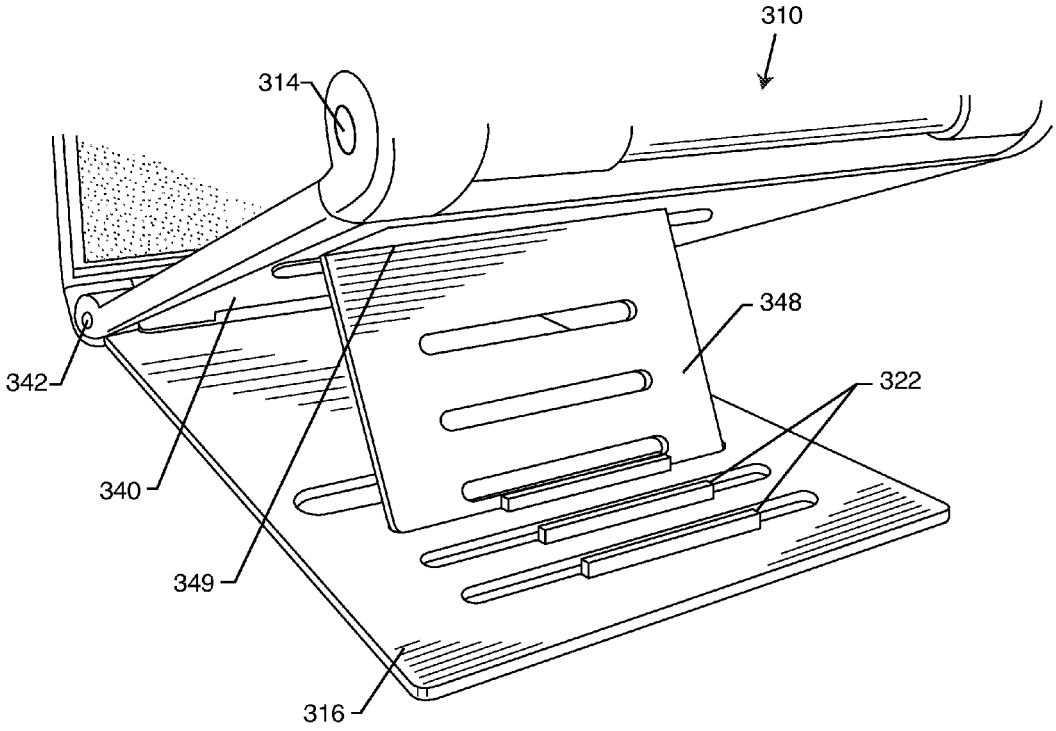
FIG. 26 is an enlarged and fragmented front perspective view taken generally on the line 26-26 of FIG. 24, and showing a lower support strut for shifting an intermediate bracket plate to an elevated, deployed position relative to an underlying base plate.

The modified support unit 310 may be further adjusted for variably selecting the height of the support platen 312 relative to the underlying base plate 316 by shifting the intermediate bracket plate 340 to an upwardly tilted orientation relative to the underlying base plate 316 (FIGS. 24-25). That is, the intermediate bracket plate 340 can be raised about the hinge 342 relative to the underlying base plate 316, with an underlying or lower second support strut 348 engaged between the intermediate bracket plate 340 and the base plate 316 as viewed in FIGS. 24-26. This lower support strut 348 is shown hingedly or pivotally coupled to the underside or rear side of the bracket plate 340 as by means of a suitable hinge 349. When the intermediate bracket plate 340 is raised, the lower strut 348 can be oriented to engage one of a plurality of raised ribs 322 formed on the base plate 316 to retain the intermediate bracket plate 340 in the selected raised position.

With this construction, the support platen 312, intermediate bracket plate 340, and base plate 316 can be oriented in a low profile, substantially two-dimensional non-deployed position in a closely stacked parallel array, as viewed in FIG. 29. In this non-deployed position, the support platen 312 is protectively concealed by the now-overlying upper support strut 318. FIGS. 27-28 show manipulation of the support platen 312 with electronic device 350 thereon toward this non-deployed position with the upper support strut 318 shifted from an angular orientation with the tab 319 thereon seated within a selected slot 344 toward the collapsed or non-deployed position protectively overlying the support platen 312 and the related electronic device 350. In this regard, a lower or inboard surface of the upper support strut 318 can be lined with a segment of foam material 356 or the like to assist in cushioning and protecting the device 350 in the non-deployed position.

Figure 30:
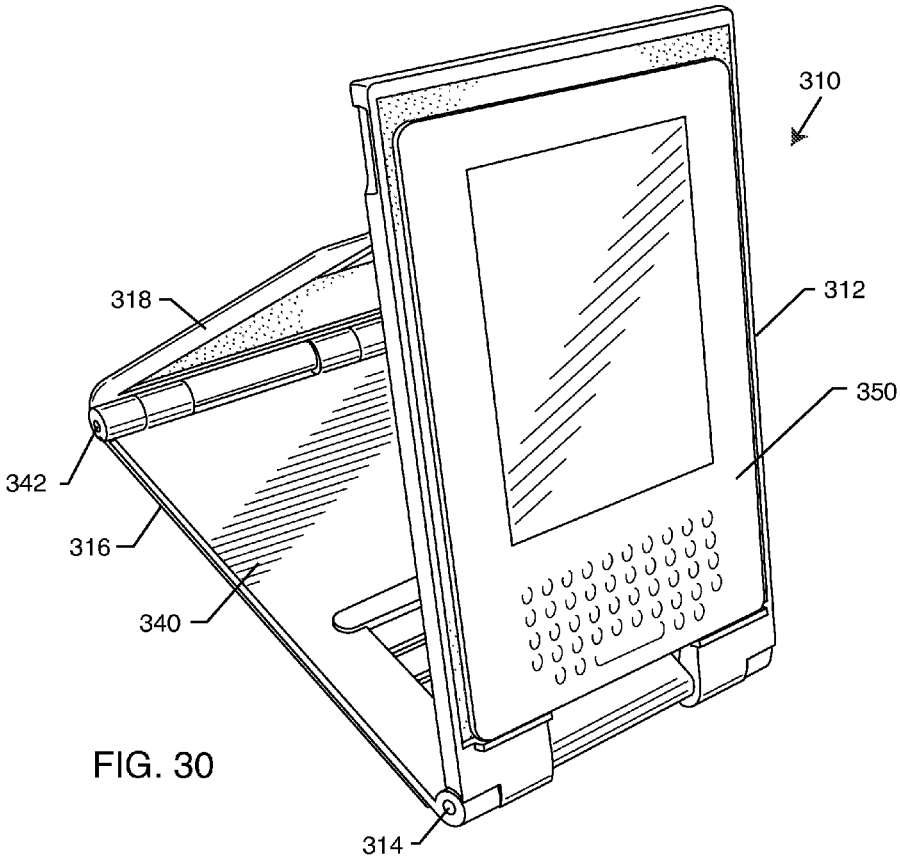
FIG. 30 is a front perspective view showing the support unit of FIGS. 24-29 in an alternative deployed position with the intermediate bracket plate substantially coplanar with the underlying base plate.

The support platen 312 can be raised as desired to a selected deployed position oriented at virtually any convenient height and angle relative to the underlying base plate 316 by suitable manipulation of the upper strut 318 and/or the lower strut 348, as described. FIGS. 24-25 show both struts 318, 348 angularly engaging the support platen 312 and the intermediate bracket plate 340, respectively. By contrast, FIG. 30 shows the upper support strut 318 angularly engaging the support platen 312, with the intermediate bracket plate 340 and the underlying base plate 316 in substantially coplanar relation with the lower strut 348 lying substantially coplanar therebetween. Clearly, persons skilled in the art will appreciate that virtually any combination of angular relationships or the two supports struts 318, 348 may be employed to oriented the support platen 312 (and the device 350 thereon) at virtually any selected height and angle relative to the underlying base plate 316.

However, when it is desired to fold up or collapse and store the unit 310, the upper support strut 318 swings upwardly from the support platen 312 (FIG. 27), followed in succession by swinging of the support platen 312 downwardly onto the underlying bracket plate 340 and then swinging the upper support strut 318 downwardly to a position protectively overlying and encasing the device 350 is a safe and secure manner, as viewed in FIG. 29. The folded unit 310 is shown in FIG. 30. In this regard, the strut t3*b* 219, or any other portion of the device, may incorporation a detent mechanism for snap-fit closure of the unit 310 in the non-deployed position.

Although various embodiments and alternatives have been described in detail for purposes of illustration, various further modifications may be made without departing from the scope and spirit of the invention. By way of examples, persons skilled in the art will recognize and appreciate that the digital device 350 shown in FIGS. 24-30 may comprise any type of electronic device carried by the support platen 312. Accordingly, no limitation on the invention is intended by way of the foregoing description and accompanying drawings, except as set forth in the appended claims.

What is claimed is:

1. A deployable support unit, comprising:

a bracket plate;

a support platen hingedly connected to said bracket plate;

a support strut for supporting said support platen at a selected angular orientation relative to said bracket plate;

said support platen being movable between a non-deployed position disposed in closely overlying and substantially parallel relation with said bracket plate, said support strut overlying and protecting said support platen in said non-deployed position, and a deployed position tilted upwardly at a selected angular orientation relative to said bracket plate;

a tab formed at a forward margin of said support strut and overlying said support platen when said unit is in said non-deployed position, and positioned to selectively engage one of a plurality of slots formed in said support platen when said unit is in said deployed position; and wherein said support strut comprises an upper support strut engageable between said bracket plate and said support platen, and further comprising a base plate hingedly coupled to said bracket plate, and a lower support strut engageable between said base plate and said bracket plate.

2. The deployable support unit of claim 1 wherein said support platen supports an electronic device thereon.

3. The deployable support unit of claim 2 wherein said support platen and said support strut are respectively lined with a protective material layer for encasing and protecting said electronic device in said non-deployed position.

4. The deployable support unit of claim 3 wherein said protective material layer comprises a foam layer.

5. The deployable support unit of claim 1 wherein said support strut is hingedly connected to said bracket plate.

6. The deployable support unit of claim 1 wherein said bracket plate is hingedly connected to said base plate generally at a rear margin thereof, and is hingedly connected to said support platen generally at a front margin thereof.

7. A deployable support unit, comprising:

a bracket plate;

a support platen hingedly connected to said bracket plate;

an upper support strut for supporting said support platen at a selected angular orientation relative to said bracket plate;

a base plate hingedly connected to said bracket plate;

a lower support strut for supporting said bracket plate at a selected angular orientation relative to said base plate;

said support platen being movable between a non-deployed position disposed in closely overlying and substantially parallel relation with said bracket plate and said base plate, said upper support strut comprising a closure lid overlying and protecting said support platen in said non-deployed position, and a deployed position tilted upwardly at a selected vertical position and a selected angular orientation relative to said base plate; and a tab formed at a forward margin of said upper support strut and overlying said support platen when said unit is in said non-deployed position, and positioned to selectively engage one of a plurality of slots formed in said support platen when said unit is in said deployed position.

8. The deployable support unit of claim 7 wherein said support platen supports an electronic device thereon.

9. The deployable support unit of claim 8 wherein said support platen and said support struts are respectively lined with a protective material layer for encasing and protecting said electronic device in said non-deployed position.

10. The deployable support unit of claim 9 wherein said protective material layer comprises a foam layer.

11. The deployable support unit of claim 7 wherein said upper support strut is hingedly connected to said bracket plate.

12. The deployable support unit of claim 11 wherein said upper support strut is hingedly connected to said bracket plate generally at a bracket plate rear margin.

13. The deployable support unit of claim 7 wherein said bracket plate is hingedly connected to said base plate generally at a bracket plate rear margin, and is hingedly connected to said support platen generally at a bracket plate front margin.

* * * * *